US007524247B2

(12) United States Patent
Williams

(10) Patent No.: US 7,524,247 B2
(45) Date of Patent: Apr. 28, 2009

(54) GOLF TRAINING SYSTEM

(76) Inventor: Jeffrey C. Williams, 2572 Moller Rd., Speedway, IN (US) 46224

( * ) Notice: Subject to any disclaimer, the term of this patent is extended or adjusted under 35 U.S.C. 154(b) by 224 days.

(21) Appl. No.: 11/132,484

(22) Filed: May 19, 2005

(65) Prior Publication Data

US 2006/0264263 A1 Nov. 23, 2006

(51) Int. Cl.
*A63B 69/36* (2006.01)

(52) U.S. Cl. ..... 473/223; 473/219; 473/226

(58) Field of Classification Search ..... 473/219, 473/223, 226–228, 231–234, 257, 268
See application file for complete search history.

(56) References Cited

U.S. PATENT DOCUMENTS 3,219,348 A * 11/1965 Dishner, Jr. ..... 473/204
4,569,525 A * 2/1986 Folger ..... 473/242
5,165,683 A * 11/1992 Beutler et al. ..... 473/228
5,228,695 A * 7/1993 Meyer ..... 473/238
5,310,188 A * 5/1994 Hernberg ..... 473/206
5,460,372 A * 10/1995 Cook ..... 473/204
5,890,977 A * 4/1999 Taylor ..... 473/409
6,346,050 B1 * 2/2002 Larson ..... 473/270
6,705,951 B2 * 3/2004 Beauregard ..... 473/206
6,793,587 B2 * 9/2004 Llewellyn et al. ..... 473/242
6,912,802 B2 * 7/2005 Cooper ..... 36/127

* cited by examiner

*Primary Examiner*—Nini Legesse
(74) *Attorney, Agent, or Firm*—Ice Miller LLP

(57) ABSTRACT

A golf training system includes a golf club, an alignment strip, and a plurality of markers for coupling to a golfer's apparel. The golf club includes a shaft having an axial centerline, a grip coupled to the shaft, and a head coupled to the shaft. The grip may have a length, a width, and a that varies from a minimum about equal to about the width to a maximum about equal to twice the width. The golf club may also include a polyhedron coupled to the shaft and positioned between the grip and the head. The polyhedron may have an axial alignment such that a vertex of the polyhedron is substantially parallel to the axial centerline of the shaft. The alignment strip may have a plurality of markings indicating a variety of possible locations for a golfer's feet in a stance, and a preferred position of a golf ball. The markers may be configured to be removably coupled to the golfer's appeal, and may serve as visual aids to the golfer during a swing.

4 Claims, 12 Drawing Sheets

GOLF TRAINING SYSTEM

TECHNICAL FIELD

This application relates to a golf training system and methods of teaching golf.

BACKGROUND

Over the years, a number of training systems have been developed to help a golfer improve his or her game. These systems vary greatly in complexity but essentially each system is an attempted solution to a single problem. That problem is teaching the golfer to develop and maintain proper form. There are essentially three elements generally described as form: stance, grip and swing. While these three elements are inseparably intertwined, many golf training systems have nevertheless been geared primarily towards only one.

U.S. Pat. No. 6,857,970 issued to Robbins discloses a method and apparatus providing a golf training apparatus configured to aid a golfer in developing a consistent golf swing. The golf training apparatus includes a triangle plane guide, a shaft coupler and a limb attachment member. The triangle plane guide includes two side members and a top member coupled to each other to form a triangular configuration. The shaft coupler is operatively coupled to a portion of the triangle plane guide and is operable to removably couple with a shaft of the golf club below a grip end of the shaft so that said triangle plane guide is disposed in a suspended position above the shaft. The limb attachment member is coupled to the triangle plane guide and operable to attach to a limb of the golfer in an adjustable manner. The triangle plane guide is operable to provide a visual reference that includes visual alignment from an apex of the two side members down the shaft toward the golf ball and visual alignment of the top member with a distant target.

U.S. Pat. No. 6,843,730 issued to Bellagamba discloses a golf training apparatus having a frame with a base and an upright frame portion having a cross frame member. A back support is attached to the upright frame portion and positioned to support the back of a golfer making practice swings and includes a Velcro fastener portion attached thereto. A belt for attaching around a golfer has a VELCRO fastener portion positioned in the back thereof and aligned for attachment to the back support fastener portion to thereby removably hold a golfer making practice swings to the golf training apparatus. The golf training apparatus includes a pair of knee brace members for holding a golfer's knees in position during a practice swing and an elongated arm with a head support yoke on the end thereof for supporting a golfer's head during practice swings.

U.S. Pat. No. 6,805,640 issued to Kim discloses a golf swing training aid to which a golf club is attached. The golf swing training aid comprises a first supporting member having an end portion and two branch portions arranged at the rear of the end portion, second supporting members connected to ends of the branch portions of said first supporting member by means of couplers for supporting the back portions of the lower arms of the golfer so that the distance between both arms is maintained, and a stationary plate and a moving plate mounted at the end portion of said first supporting member for holding fixedly the shaft of the golf club.

U.S. Pat. No. 6,780,122 issued to Belanger discloses a golf training device for swing improvement including a base member, a mast member, and swing indicators. The mast member is coupled with the base member and has opposite ends and a plurality of holes. The swing indicators are insertable into holes.

It would be desirable to provide a golf training system that helps a golfer of any skill level to improve each area of his or her form: stance, grip, and swing. It would be further desirable to provide a golf training system that is simply enough to be readily understood by and useful to a novice golfer. Finally, it would be desirable to provide a golf training system that can be easily transported to and from a golf course or driving range, ideally in a golf bag or a similar container.

SUMMARY

A golf training system includes a golf club, an alignment strip, and a plurality of markers for coupling to a golfer's apparel. The golf club includes a shaft having an axial centerline, a grip coupled to the shaft, and a head coupled to the shaft. The grip may have a longitudinal length, a width perpendicular to the longitudinal length, and a height perpendicular to the width that varies from a minimum value about equal to about the width to a maximum value about equal to twice the width.

The golf club may also include a polyhedron coupled to the shaft and positioned between the grip and the head. The polyhedron may have an axial alignment such that a line extending through a vertex of the polyhedron is substantially parallel to the axial centerline of the shaft. The alignment strip may have a plurality of markings indicating a variety of possible locations for a golfer's feet in a stance, and a preferred position of a golf ball. The markers may be configured to be removably coupled to the golfer's appeal, and may serve as visual aids to the golfer during a swing.

A golf training method may comprise placing an alignment strip on the ground and holding a golf club comprising a polyhedron with a plurality of markings so that a first marking of the plurality of markings is visible. The method may further include raising the golf club to a second position so that a second marking of the plurality of markings is substantially parallel to the alignment strip, and raising the golf club to a third position so that a third marking of the plurality of markings is substantially perpendicular to the alignment strip.

The golf training method may also include lowering the golf club so that a second marking of the plurality of markings is substantially parallel to the alignment strip. The method may also include further lowering the golf club so that so that a third marking of the plurality of markings is visible.

DETAILED DESCRIPTION OF THE DRAWINGS

Figure 1:
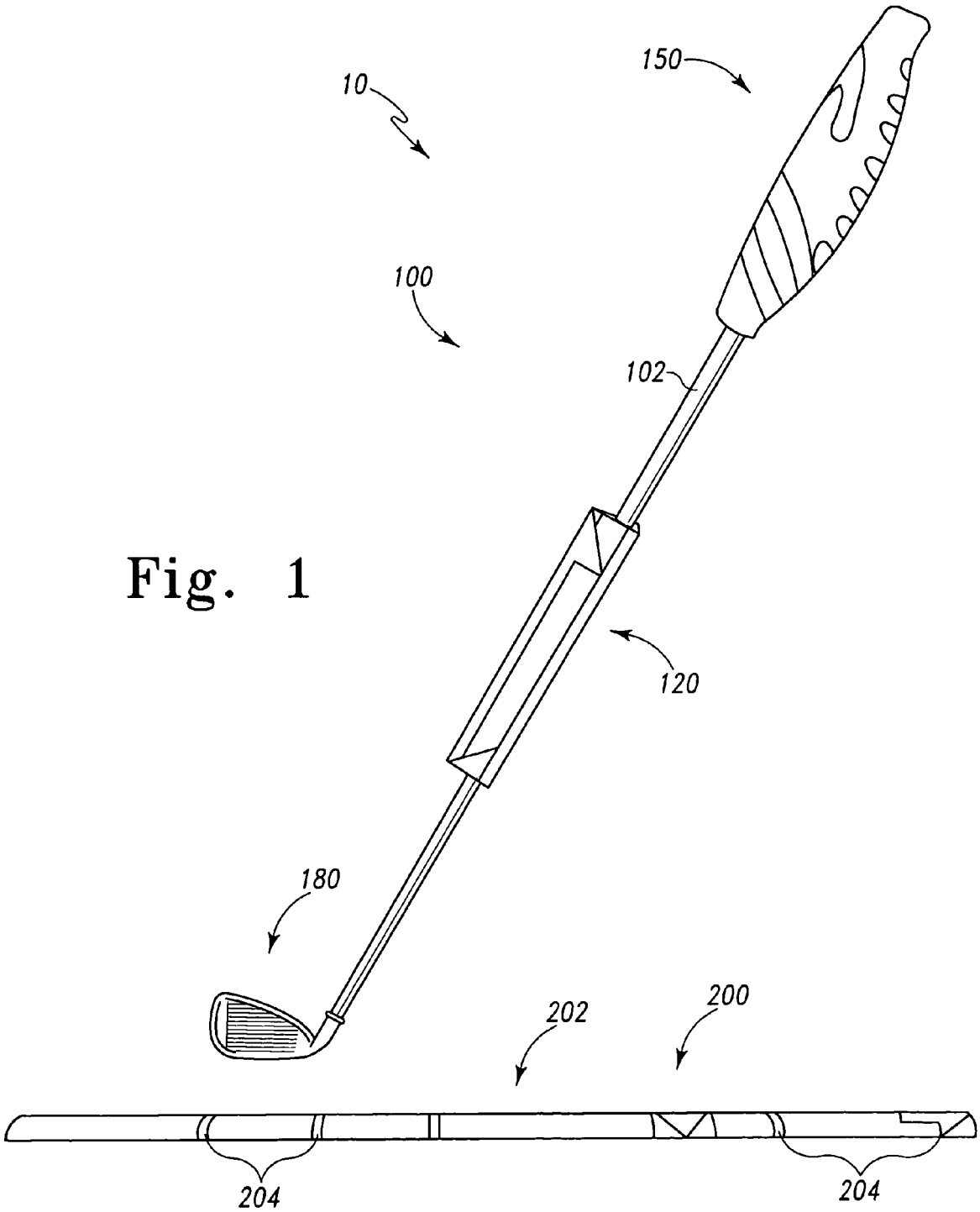
FIG. 1 is a front side view of a golf training system.

Turning to FIG. 1, a golf training system 10 is shown. The golf training system 10 includes: a golf club 100 and an alignment strip 200. The golf club 100 includes: a grip 150, a shaft 102, a polyhedron 120, and a golf club head 180. The golf club head 180 and the shaft 102 of the golf club 100 may be that of any traditional wood, iron, or putter. For simplicity, the club 100 depicted in FIGS. 1-10 is a 7 iron, however, the claimed invention is by no means limited to a particular type of golf club. Furthermore, the golf club 100 of the golf training system 10 may be a men's, women's, or junior-sized club.

Figure 2A:
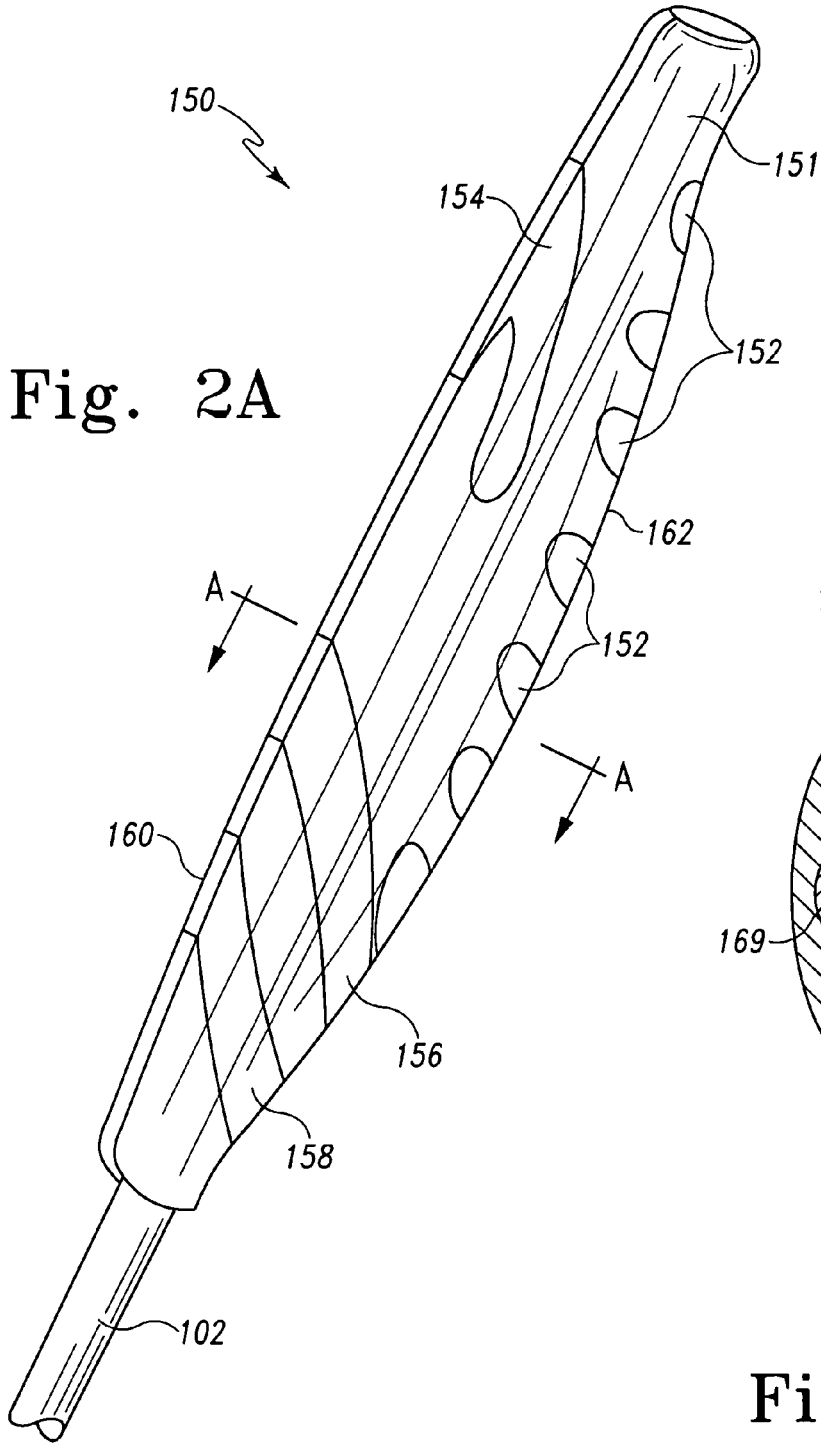
FIG. 2A is a side view of a grip of the golf training system of FIG. 1.

The alignment strip 200 includes a body 202 and markings 204. The markings 204 indicate stance alignment and club alignment, and are explained more fully in FIGS. 4-10. Turning to FIG. 2A, the grip 150 is shown in more detail. As can be seen in FIG. 2A, the grip 150 includes a body 151, and a series of markings 152, 154, 156 and 158. The body 151 is preferably fabricated from a resilient, rigid material, such as rubber, plastic, or the like, that has a relatively high coefficient of static friction with human skin. The finger markings 152 indicate the preferred position for the golfer's fingers, excluding the golfer's thumbs, and release finger. The marking 154 indicates the preferred position for the golfer's non-dominant thumb. For example, a right handed golfer's non-dominant thumb is his left thumb. The marking 156 indicates the preferred position for the golfer's trigger thumb, which is another term for the golfer's dominant thumb. The marking 158 indicates the preferred position for the golfer's release finger, which is another term for the golfer's index finger on the golfer's dominant hand. Each of the markings 152, 154, 156, and 158 exist identically on each side of the grip 150, so that the grip 150 may be used for either a right-handed or a left-handed golfer.

Figure 2B:
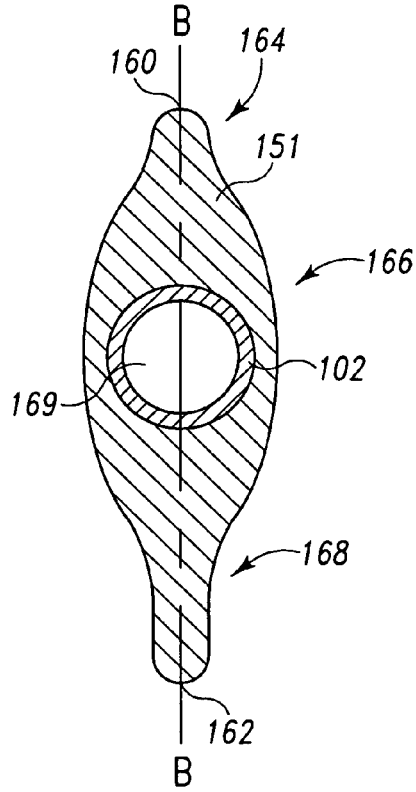
FIG. 2B is a cross section of the grip shown in FIG. 2A.

FIG. 2B is a cross section of the grip 150 shown in FIG. 2A. As can be seen in FIG. 2B, the grip 150 is substantially symmetrical about centerline B-B. As can be seen from the cross sectional view, the grip 150 is shaped somewhat like the volume defined by a pair of human hands gripping a traditional cylindrical golf club grip. In fact, the cross sectional shape of the grip 150 may be created by affixing malleable clay to a traditional golf club shaft, and having a professional golfer grip the malleable clay using a gripping action that is generally accepted as facilitating a golf club swing. The resulting in a deformation of the clay is substantially the same as the volume defined by the palms, thumbs, and fingers of the golf professional, and the resulting shape (when fabricated as the grip 150) facilitates the reproduction of this gripping action by another golfer.

The cross section of the grip 150 resembles, as one would expect, a partially flattened cylinder. In particular, the cross section of the grip 150 has an elliptical portion 166, a top elongation 164, and bottom elongation 168. the top elongation 164 follows the contour between a golfer's index finger and thumb when that person is gripping a cylinder in the hand. Similarly, elongation 162 is shaped similarly to the volume defined by a person curling his or her fingers towards his or her palm. The grip 150 is symmetrical about the axis B-B because a golfer's hands define essentially the same volume whether the golfer holds the grip 150 in a right-handed or a left-handed fashion. The width of the grip 150, measured perpendicular to the axis B-B, is between about 1.0 cm and 5.0 cm, and is preferably about 2.0 cm. The height of the grip 150, measured along the axis B-B, varies from between about 2.0 cm to 4.0 cm near the ends of the grip 150, to between about 3.0 cm and 7.0 cm near the middle of the grip 150. The size of the grip 150 may vary significantly depending on the intended golfer, for example for a child versus for an adult.

The grip 150 includes a tubular cavity 169 with an opening for receiving the shaft 102 at the end of the grip 150 nearest to the golf club head 150. The tubular cavity 169 does not, in a preferred embodiment, extend through the entire length of the grip 150. As is the case with most golf club grips, the grip 150 preferably includes a capping or closing end portion that covers the top end of the shaft 102.

The overall shape and contour of the grip 150 is such that the golfer is essentially forced to grip the club 100 in a manner generally accepted as promoting proper club alignment. The centerline B-B shown in FIG. 2B passes through a top edge 160 and a bottom edge 162 of the golf grip 150. A plane passing through the top edge 160 and the bottom edge 162, when extended to the golf club head 180, additionally contains the leading edge 182 (shown in FIG. 4) of the golf club head. As is shown in FIG. 2B, a plane passing through the top edge 160 and the bottom edge 162 also passes through the centerline of the shaft 102.

Figure 3A:
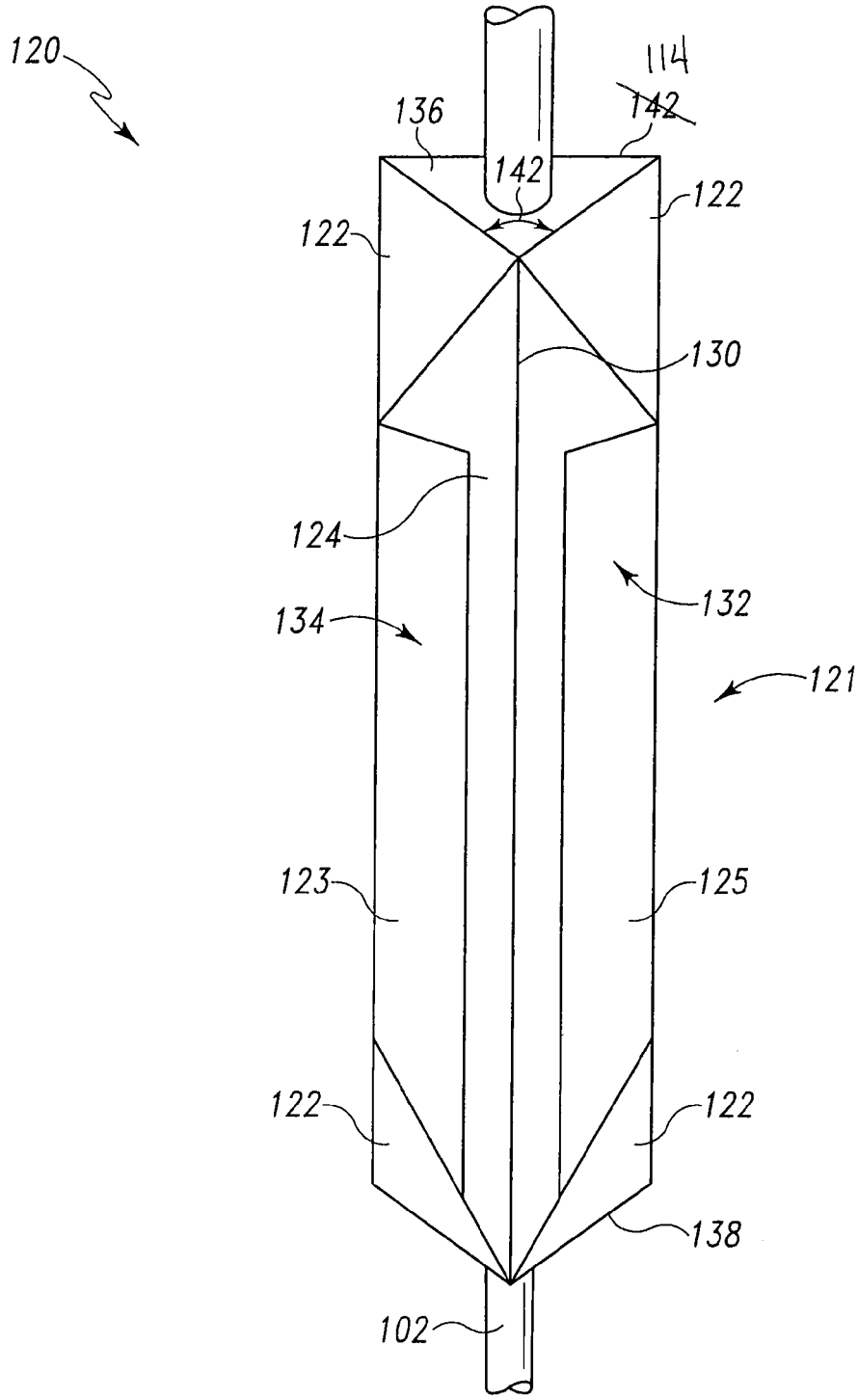
FIG. 3A is a front view of a polyhedron of the golf training system of FIG. 1.

Turning to FIG. 3A, the polyhedron 120, and the markings contained on the polyhedron 120, are each shown in greater detail. The polyhedron 120 serves as a visual indicator to assist the golfer in determining whether the golf club 100 is in the proper orientation throughout the golfer's swing. As used herein, the term "polyhedron" refers to a solid substantially bounded by polygons. In an embodiment shown in the drawings, the polyhedron 120 is a triangular prism, which is a polyhedron having congruent, parallel triangles as bases and rectangles as faces.

In other embodiments, the polyhedron 120 may have faces 132 and 134 that are canted, or that are curved to form a section of a sphere, an ellipsoid, or the like. In these other embodiments, the faces of the polyhedron 120 may be something other than a regular polygons. The exact shape of the polyhedron 120 is not important, so long as the polyhedron 120 has at least two faces 132 and 134, and these at least two faces 132 and 134 may be themselves "flat" or "curved."

In a preferred embodiment, the at least two faces 132 and 134 meet at a vertex 130. In some embodiments the vertex 130 may be curved, or may comprise a series of straight and curved line segments. In the embodiment shown in the drawings, the vertex 130 is a straight line. Again, as long as the polyhedron 120 has at least two faces 132 and 134 that are capable of receiving markings, the exact shapes are not important. For clarity, the markings on the polyhedron 120 will be described herein as colors. It should be noted, however, that other indications, such as numbers, shading, patterns, or the like, could also be used to mark these areas. The use of colors in this description is purely exemplary and should not be read to limit the attached claims in any fashion.

The markings may consist of yellow markings 122, green marking 123, red marking 124, and blue marking 125. These markings are contained on a body 121 of the polyhedron 120. The polyhedron 120 has a vertex 130 which is parallel to the shaft 102. Similarly, the vertex 130 of the shaft 120 is parallel to the top edge 160 and the bottom edge 162 of the grip 150, and a plane passing through the top edge 160 and the bottom edge 162 of the grip 150 also passes through the vertex 130.

Figure 3B:
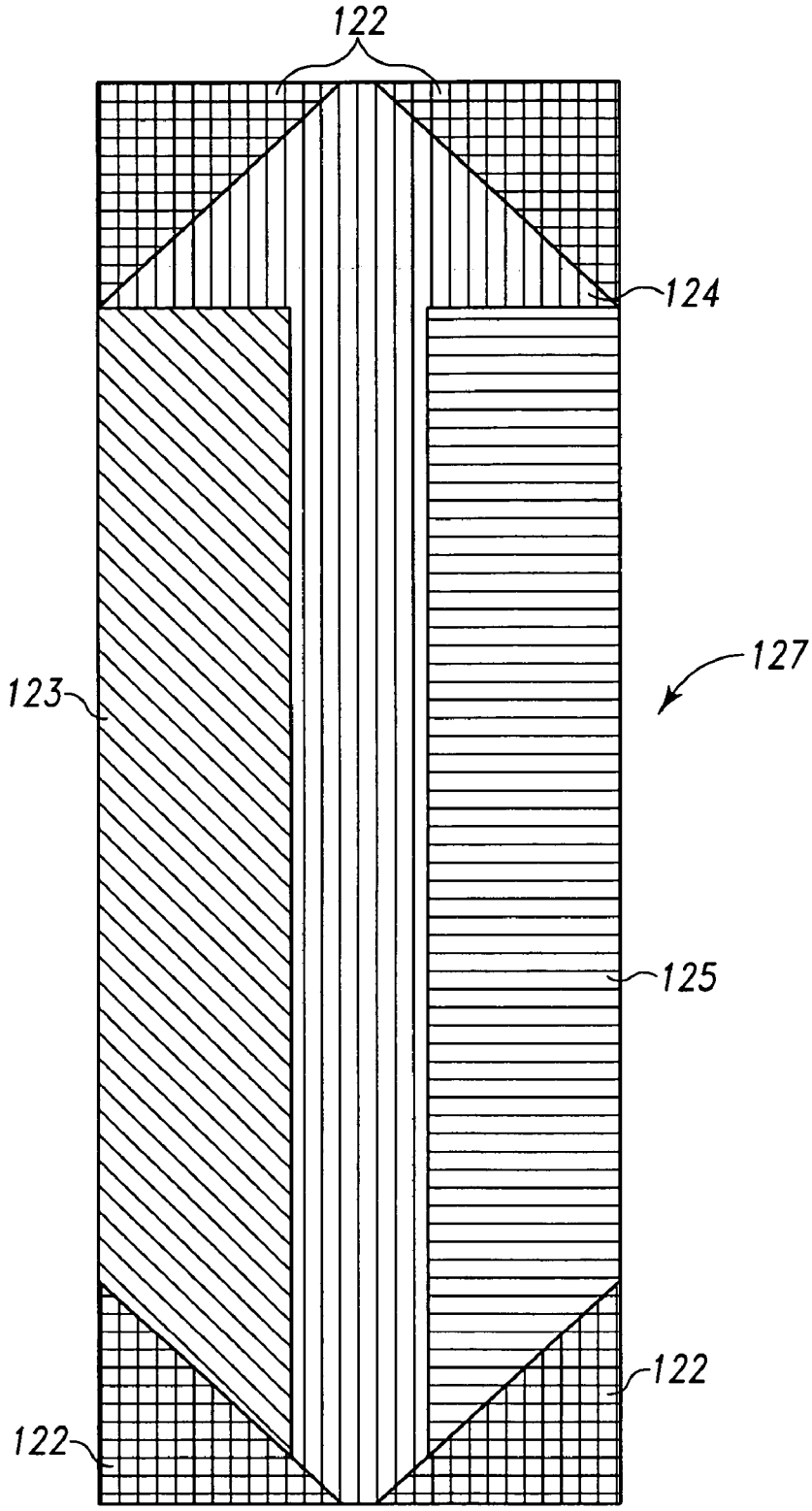
FIG. 3B is a front view of sheet having a set of markings for use on polyhedron of FIG. 3A.

As shown in FIG. 3B, the markings on the body 121 of the polyhedron 120 may be printed on a sheet 127. For example, the sheet 127 may comprise metal, a thin polyester film (such as Mylar), cardboard, paper, or any other surface that is fairly light-weight and capable of retaining markings.

Figure 3C:
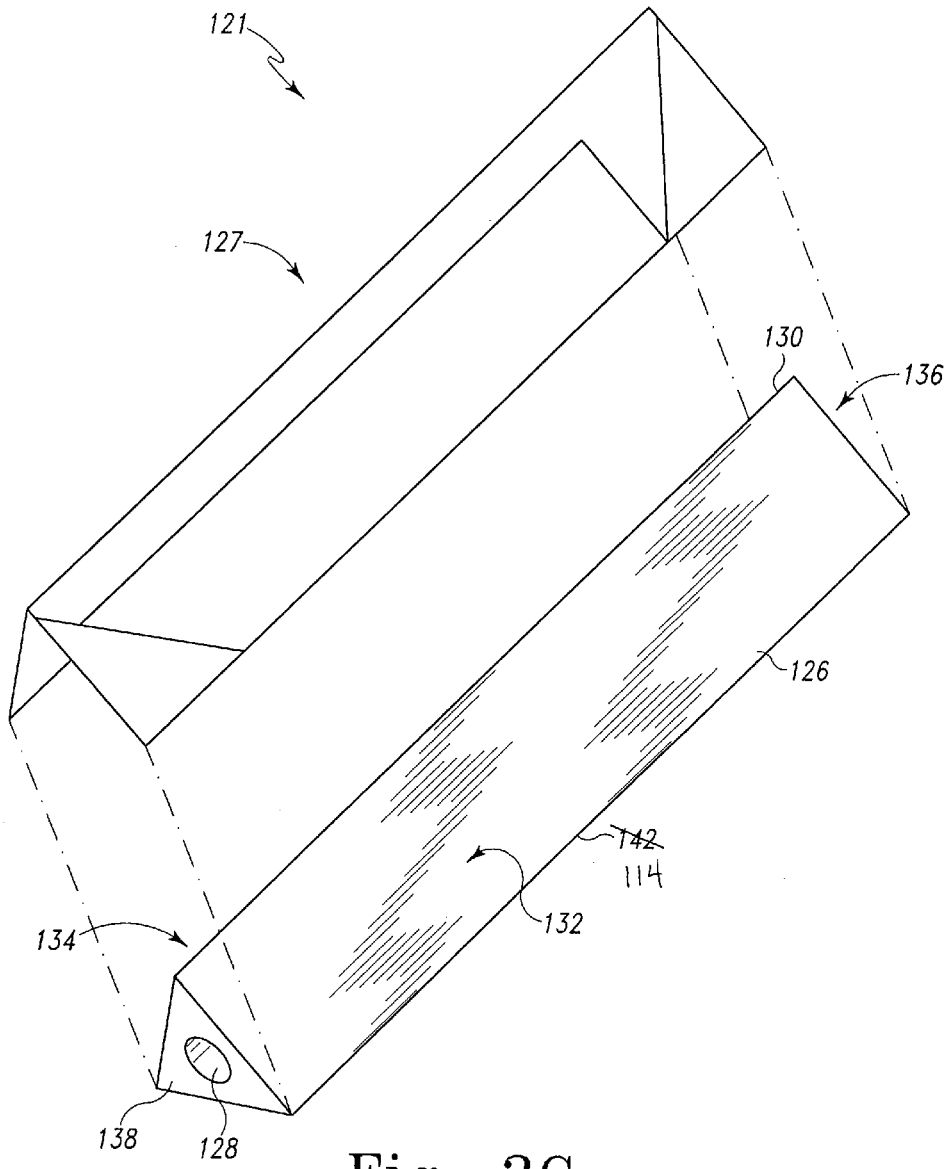
FIG. 3C is a perspective view of the sheet having a set of markings of FIG. 3B being assembled with the body of the polyhedron of FIG. 3A.

As shown in FIG. 3C, the body 121 of the polyhedron 120 may comprise a polyhedron base 126 and a sheet 127. The polyhedron base 126 may be, for example, a light weight material such as synthetic foam, plastic, wood, foam rubber, Styrofoam, or the like. The flat surface 127 may be folded and affixed to the polyhedron base 126 by an adhesive substance, such as glue.

The distance along either of faces 132 and 134 of the polyhedron 120, measured perpendicularly from the vertex along the face 132 or 134, is between about 2.0 cm and 10.0 cm, and is preferably about 4.0 cm. The face 114 of the polyhedron 120 is between about 3.0 cm and 9.0 cm, and is preferably about 6.0 cm. The length of the polyhedron 120 is between about 10.0 cm and 40.0 cm, and is preferably about 25.0 cm. The dimensions of the polyhedron 120 may vary, for example, with the length of the shaft 102, or based on aesthetics.

Although not shown in the drawings, the invention may also be practiced by fabricating polyhedron base 126 out of a markable material and applying markings directly to its surface. However, from a manufacturing perspective, it may be easier to print the markings onto a flat surface than onto the polyhedron base 126. Nevertheless, the attached claims should not be considered limited by the illustrative embodiment shown in FIGS. 3A-3C.

Figure 4:
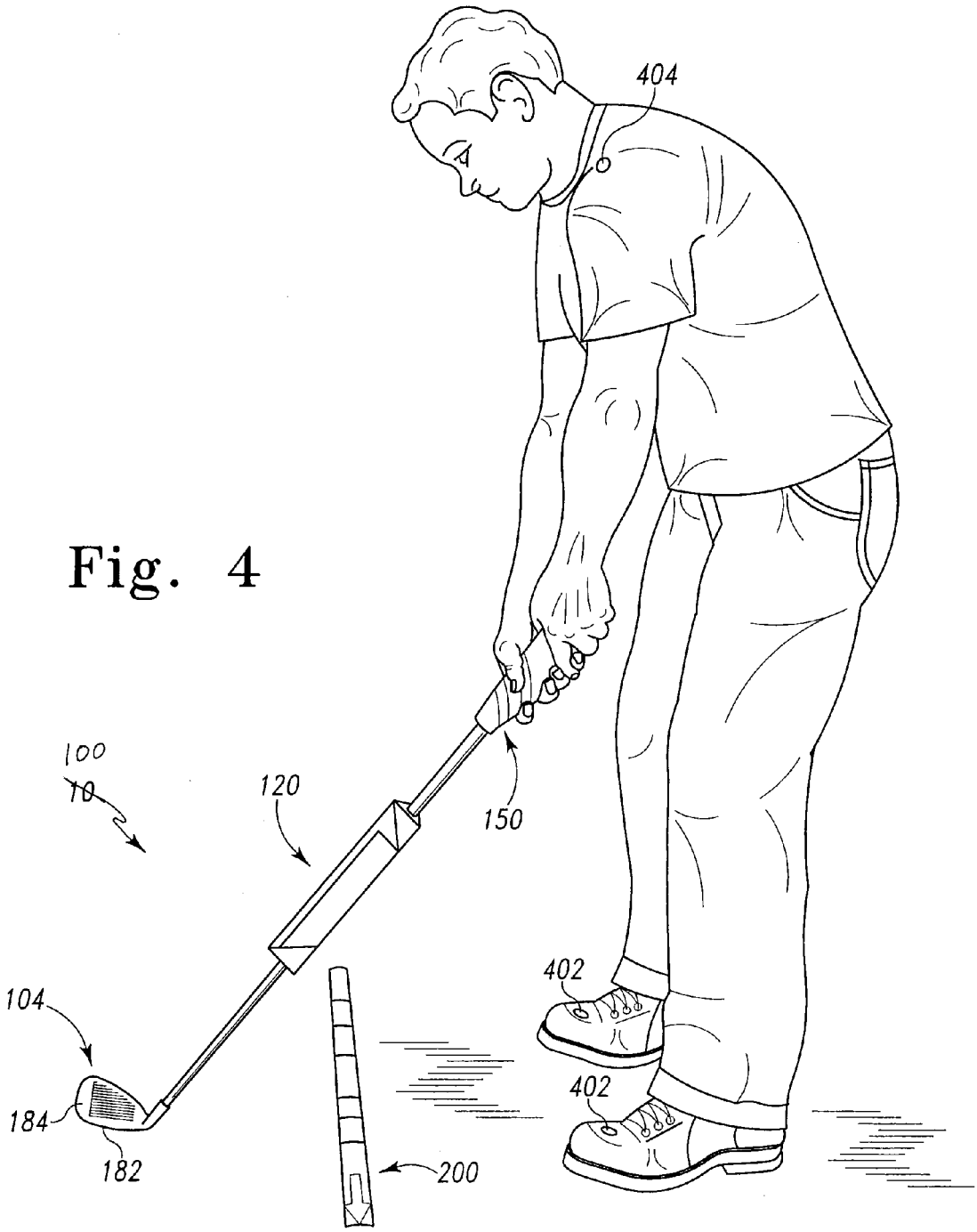
FIG. 4 is a side view of a golfer in a first position utilizing the golf training system shown in FIG. 1.

Turning to FIG. 4, a golfer is shown utilizing the golf training system 10. As shown in FIG. 4, the golfer is holding the club 100 by the grip 150. On the ground between the golfer and the head 180 of the golf club 100 is the alignment strip 200. The exact location of the alignment strip 200 between the golfer and the head 180 of the club 100 is not crucial; however, the strip 200 should be substantially perpendicular to a pair of lines running longitudinally down the center of the golfer's feet. As shown in FIG. 4, markers 402 and 404 are affixed to the golfer's shoes and to the golfer's left shoulder, respectively. These markers may be, for example, small colored stickers.

Figure 5:
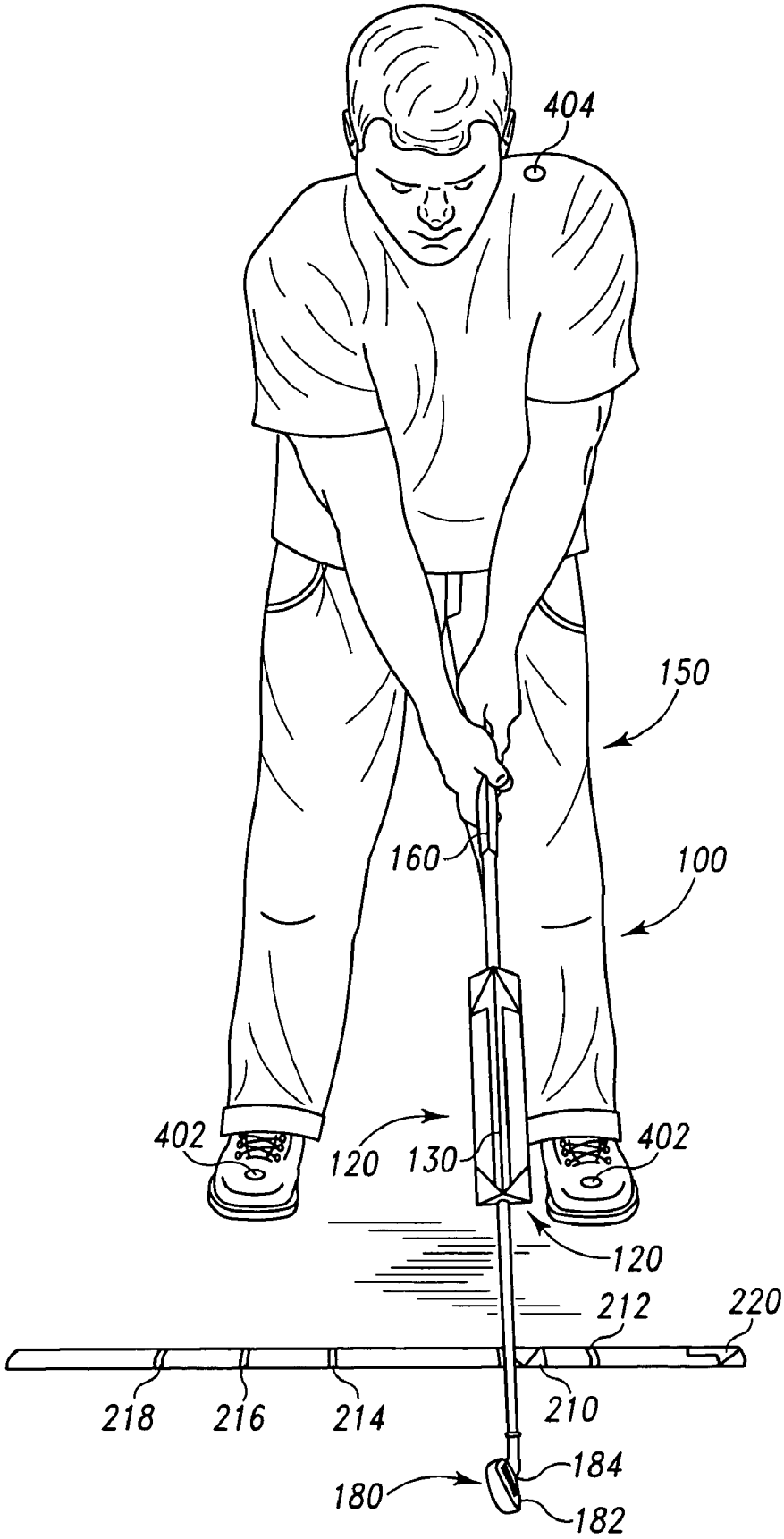
FIG. 5 is a front view of a golfer in the first position utilizing the golf training system shown in FIG. 1.

To simplify the explanation of the golfer's progression through a swing, the golf swing is broken down herein into six separate positions. Each position of the swing is really a snapshot in time of the golfer's continuous movement throughout the swing. FIG. 4 is a side view of the golfer in the first position. FIG. 5 is a front view of the golfer in the first position.

As can be seen in FIGS. 4 and 5, the golfer is holding the club 100 such that a plane running through the top edge 160 and bottom edge 162 of the grip 150, the vertex of the polyhedron 120, and the front edge 182 of the golf club head 180, is substantially perpendicular to the front of the golfer. The alignment strip 200 comprises a marking 212 indicating a preferred horizontal position for the golfer's left foot. The marking 220 on the alignment strip 200 indicates the direction of ball travel at the completion of the swing. The markings 214, 216, and 218 indicate varying preferred positions for the golfer's right foot, depending on the length of the shaft 102. For example, the golfer would align his or her right foot with the marker 214 for a golf club 100 with a shorter shaft 102, and with the marker 218 for a golf club 100 with a longer shaft 102.

The marking 210 indicates the preferred horizontal location of the golf ball, and also the preferred location of the front edge 182 of the golf club head 180. (For simplicity, the drawings do not show a golf ball.) The golfer's hands are shown on the grip 150 in positioned in the locations indicated by the markings 152, 154, 156, and 158 on the grip 150. (See FIG. 2A.) It should be noted that the golfer shown in the drawings is right-handed; however, the golf training system 10 is equally suited for both left-handed and right-handed golfers. Similarly, the golfer in the drawings is shown using an interlocking grip; however, the golf training system 10 is equally suited for use with an overlapping or "Vardon" grip, or with a "ten-finger" grip. The inclusion in the drawings of only a right-handed golfer utilizing the interlocking grip is to avoid duplication, and should not be read to limit the attached claims in any way.

As shown in FIGS. 4 and 5, if the golfer stands in a preferred position one, the golfer will be able to see all four yellow markings 122 on the polyhedron 120, as well as the markers 402 affixed to the golfer's shoes. For simplicity, it is preferred that the markers 402 on the golfer's shoes match the markings 122, either in color, shading, pattern, or the like. In order to see all four of the yellow markings 122, the golfer must have the rotational orientation of the club 100 in a preferred position, such that a plane passing through the top edge 160 and the bottom edge 162 of the grip 150 is substantially perpendicular to the front of the golfer.

In order to also see the markers 402 affixed to the golfer's shoes, the golfer must lower his or her arms sufficiently. This is helpful because many golfers, especially beginners, may tend to hold the grip 150 too high from the ground, so that the angle between the shaft 102 and the arms of the golfer shown in the side view of FIG. 4 is too obtuse, possibly as high as one-hundred eighty degrees. Additionally, to also see the markers 402 affixed to the golfer's shoes, the golfer must lower his or her head, as is required to achieve the preferred position.

For advanced golfers, the vertex angle 142 of the polyhedron 120 may be more acute. Fashioning the polyhedron 120 with a more acute vertex angle 142 would require the golfer to have a more precise rotational orientation of the club 100 in order to see all four of the yellow markings 122 on the polyhedron 120. On the other hand, a wider vertex angle 142 on the polyhedron 120 would allow the golfer more leeway in the rotational orientation of the club, while still allowing the golfer to see all four of the yellow markings 122 on the polyhedron 120.

As shown in the drawings, the vertex angle 142 of the polyhedron 120 is about sixty degrees, however, more acute or more obtuse angles may be used depending on the expertise of the golfer using the golf training system 10. For example, a more experienced golf may prefer a more acute vertex angle 142 to hone his or her skills, while a beginning golfer may prefer a wider vertex angle 142 to simplify learning the game.

In addition to seeing the four yellow markers 122 in a preferred position one, from the golfer's perspective the top edge 160 of the grip 150 should be aligned with the vertex 130 of the polyhedron 120, with the leading edge 182 of the golf head 180, and with the marking 210 on the alignment strip 200. If the golfer has placed his or her hands on the grip 150 in accordance with the markings 152, 154, 156, and 158 thereon, has achieved the visual alignment described in this paragraph, and has placed his or her feet on the ground according to the horizontal markings on the alignment strip 220, then the golfer is substantially in a preferred form for the first position.

There are, of course, additional factors to consider when determining whether the golfer is in exactly the preferred stance, such as whether the golfer has a club 100 of the proper size, has his or her knees bent, keeps his or her head down, or the like. Nevertheless, by using the golf training system 10 as described in the preceding paragraphs, the golfer will have overcome many of the difficulties associated with entering the preferred pre-swing stance of position one.

Figure 6:
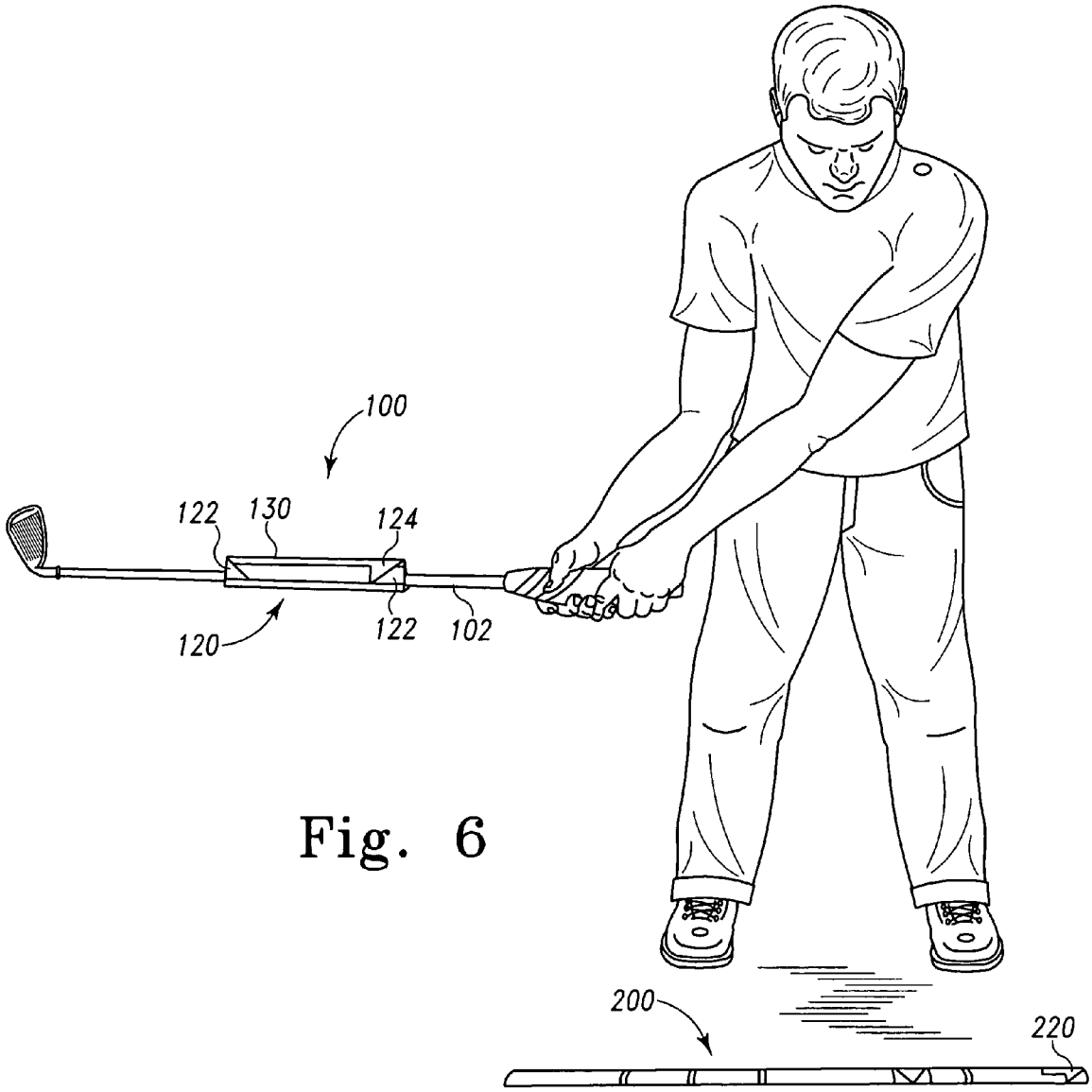
FIG. 6 is a front view of a golfer in a second position utilizing the golf training system shown in FIG. 1.

Turning to FIG. 6, a golfer is shown in the second position. As can be seen in FIG. 6, the red arrow shaped marking 124 at the vertex of the polyhedron 120 is parallel to the alignment strip 200, and pointing in the same direction as the arrow shaped marking 220 on the alignment strip 200. In this preferred second position, the grip 150 is at about the waist height of the golfer. If the golfer looks to his or her right while in this preferred second position, he or she will still see all four of the yellow markings 122 on the polyhedron 120, as well as the arrow shaped marking 124. Additionally, the vertex 130 of the polyhedron 120 is parallel to the ground, yet closer to the sky than any other line running along the surface of the polyhedron 120.

Figure 7:
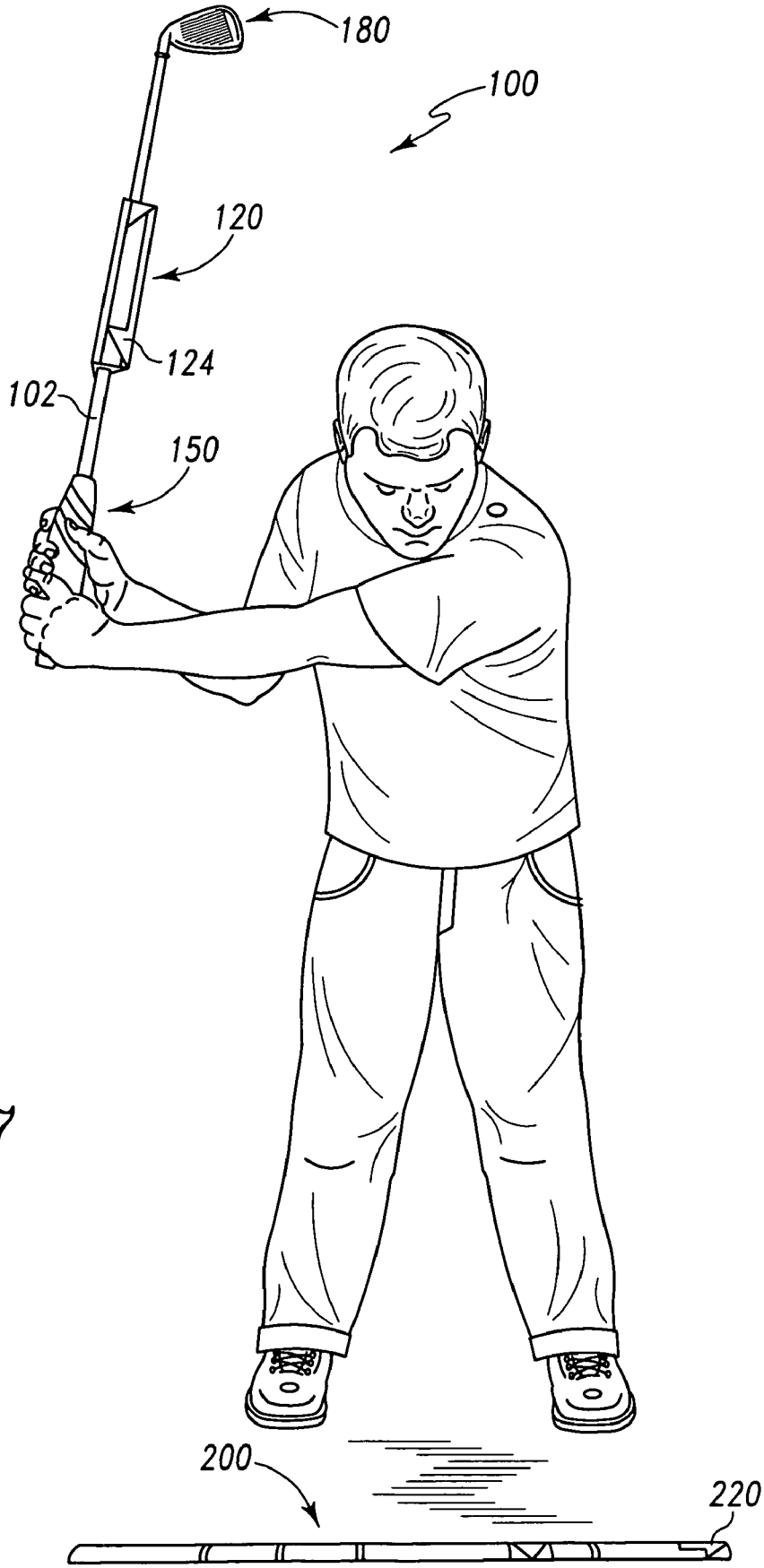
FIG. 7 is a front view of a golfer in a third position utilizing the golf training system shown in FIG. 1.

Turning to FIG. 7, the golfer is shown in the third position with the golf club 100 near "the top of the swing." In the third position, the arrow shaped red marking 124 of the polyhedron 120 is now pointing at the alignment strip 200. That is to say, that the grip 150 of the golf club 100 is slightly in front of the golfer, while the golf club head 180 is slightly behind the golfer. The angle of the golf club 100 is such that a line drawn through the center of the shaft 102, and extending out of the grip 150 would intersect with a line drawn horizontally through the alignment strip 200. The grip 150 is at approximately the height of the golfer's shoulders. The golfer's left arm is parallel to the alignment strip.

Figure 8:
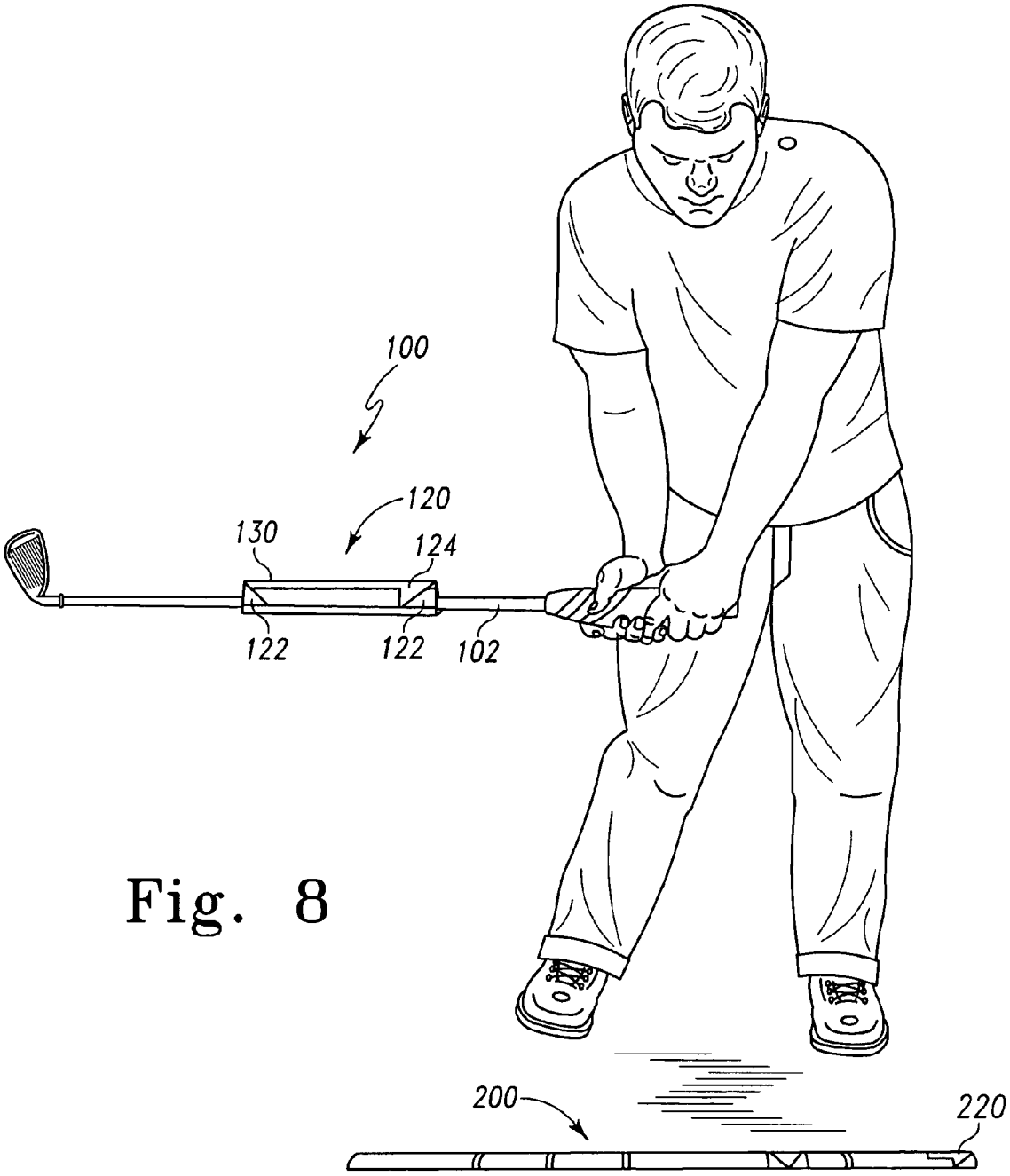
FIG. 8 is a front view of a golfer in a fourth position utilizing the golf training system shown in FIG. 1.

Turning to FIG. 8, the golfer is now in the fourth position, which is similar in many respects to the second position shown in FIG. 6. However, in FIG. 6 the golfer was on the upswing so that a large portion of the golfer's weight was on his right foot, whereas in FIG. 8 the golfer is in the downswing, and the weight is predominantly on his left foot. Additionally, the golfer's arms are extended more fully in the preferred fourth position than they were in the second position.

Regarding the golf club 100, the shaft 102 is again parallel to the horizontal marker 200. Additionally, the shaft 102 is parallel to the ground. The red arrow shaped marking 124 at the vertex 130 of the polyhedron 120 is parallel to the alignment strip 200, and pointing in the same direction as the arrow shaped marking 220 on the alignment strip 200. The grip 150 is again at about the waist height of the golfer. If the golfer looks to his or her right while in the preferred fourth position, he or she will again see all four of the yellow markings 122 on the polyhedron 120, as well as the arrow shaped marking 124.

Figure 9:
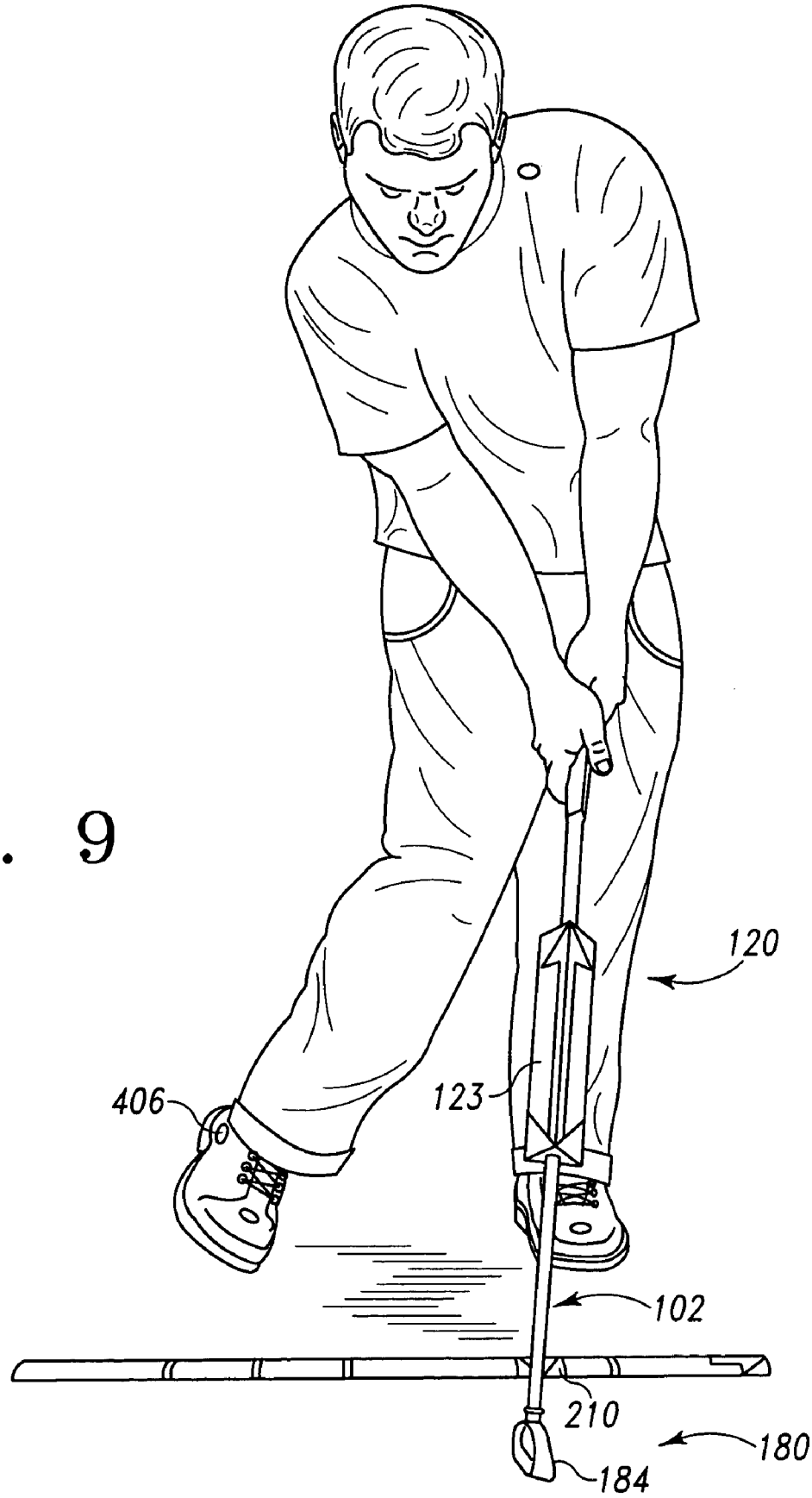
FIG. 9 is a front view of a golfer in a fifth position utilizing the golf training system of FIG. 1.

Turning to FIG. 9, the golfer is shown in the fifth position, which is roughly the point of the swing where the face 184 of the golf club head 180 comes in contact with a golf ball (not shown). As shown in FIG. 9, the golfer is now able to see a green marking 406 on the outside arch of the golfer's right foot. This green marking 406 will only be visible if the golfer bends his or her right knee at the bottom of the swing, as is shown in FIG. 9. If the golfer leaves his or her right foot "planted," then he or she will not be able to see the green marking 406, and he or she will thereby know that his or her form needs improvement.

If the golfer has axially rotated the club forward, as is preferred in a swing, then the golfer will see the green marking 123 on the polyhedron 120. If the golfer does not see the green marking 123, then the club is not properly rotated. In one embodiment, the grip 150 may have a blue-colored marking covering substantially the forward-facing surface, and a green-colored marking covering substantially the reverse-facing surface (where forward and reverse are described in terms of the golf ball's intended direction of travel). In this embodiment, the golfer will also be able to see the green colored reverse-facing surface of the grip 150, to the extent said surface is not covered by the golfer's hands, when the golfer is in the preferred fifth position.

Figure 10:
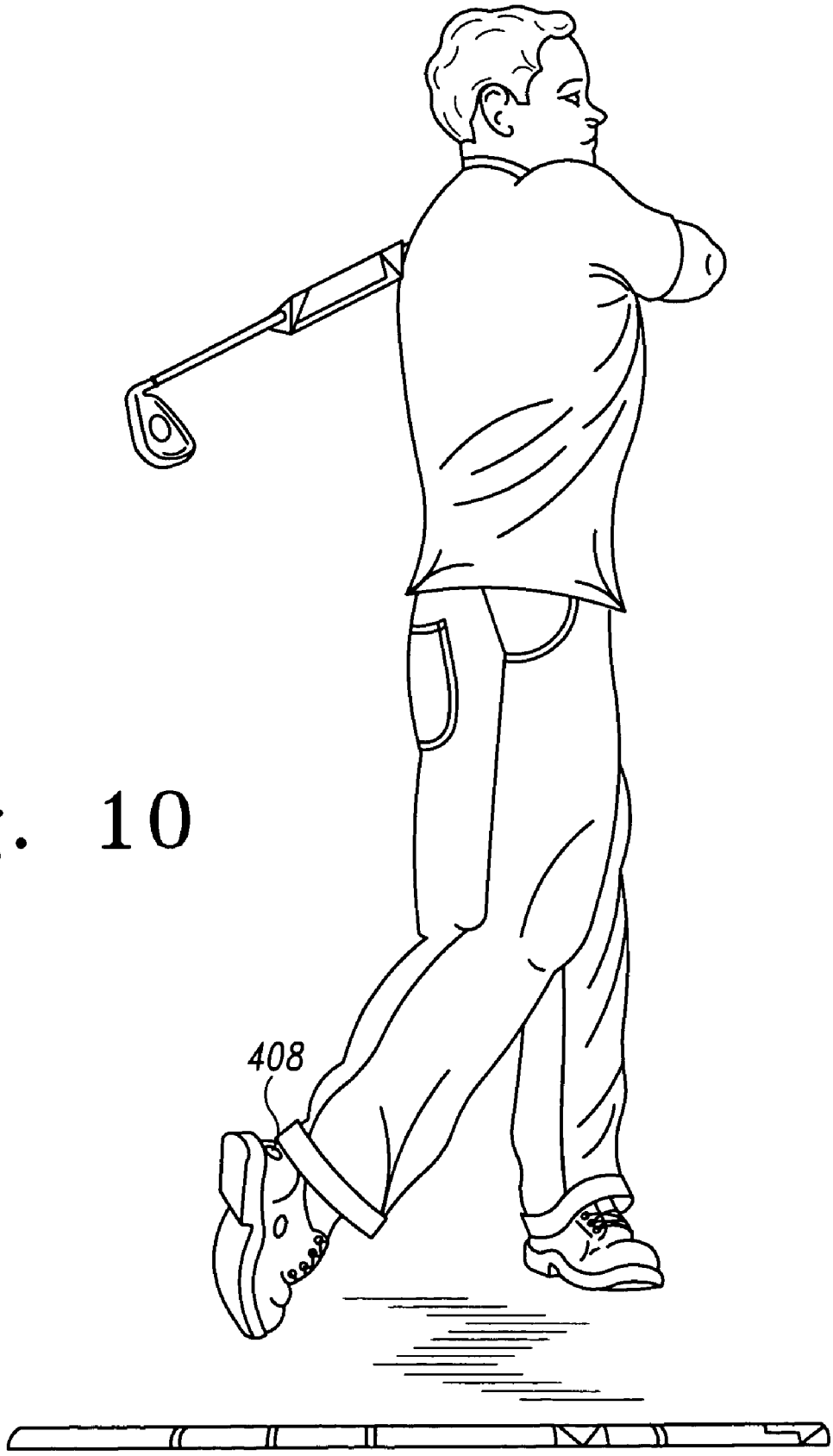
FIG. 10 is a front view of a golfer in a sixth position utilizing the golf training system of FIG. 1.

Turning to FIG. 10, the golfer is shown in the preferred sixth position, also known as the "follow through" position. In this position, the end of the grip 150 closest to the golf club head 180 is proximate to or touching the shoulder of the golfer near the location of a blue marker 404 (as shown in FIG. 9). Additionally, the golfer is able to see a blue marker 408 on the heel of the golfer's right foot. In one preferred embodiment, an additional blue marker (not shown) is placed on the shaft 102 of the golf club 100 near the grip 150. In this preferred embodiment, the golfer may align the blue marker (not shown) on the shaft with the marking 404 on the golfer's shoulder.

If the golfer achieved each of the preferred first through sixth positions described above in connection with FIGS. 4-10, then the golfer is substantially less likely to "hook" or "slice" the golf ball. More importantly, if the golfer did not achieve each of the six preferred positions, the golfer will have had a continuous visual feedback throughout his or her swing indicating what mistakes he or she made. For example, if the golfer did not see the green marking 123 on the polyhedron 120 in the fifth position, the golfer knows to "twist" the club forward more on his or her downswing. If the golfer did not see the green marking 406 on the outside arch of the golfer's right foot in the fifth position, the golfer knows to bend his or her knee and shift his or her weight more.

Throughout this specification, unless the context requires otherwise, the words "comprise" and "include" and variations such as "comprising" and "including" will be understood to imply the inclusion of an item or group of items, but not the exclusion of any other item or group items.

While various embodiments of the invention have been described, it will be apparent to those of ordinary skill in the art that many more embodiments and implementations are possible within the scope of the invention. Furthermore, although various indications have been given as to the scope of this invention, the invention is not limited to any one of these but may reside in two or more of these combined together. Accordingly, the invention is not to be restricted except in light of the attached claims and their equivalents.

What is claimed is:

1. A golf club for use with a golf training system, the golf club comprising:

a shaft having an axial centerline;

a grip, wherein the grip is coupled to a first end of the shaft;

a head having a front edge, wherein the head is coupled to a second end of the shaft that is opposite the first end of the shaft; and a polyhedron, wherein the polyhedron is coupled to the shaft and positioned between the grip and the head, and wherein the polyhedron has an axial alignment such that a vertex of the polyhedron is co-planer with the axial centerline of the shaft;

wherein the vertex of the polyhedron is co-planer with the front edge of the head.

2. The golf club of claim 1, wherein the polyhedron comprises a body having a length of between about 10.0 cm and 40.0 cm.

3. The golf club of claim 2, wherein the polyhedron comprises substantially tubular channel having an axial centerline extending longitudinally through the body.

4. The golf club of claim 2, wherein the substantially tubular channel of the body of the polyhedron has a diameter that is substantially the same as a diameter of the shaft.

* * * * *